US005099384A

United States Patent [19]

Chin

[11] Patent Number: 5,099,384

[45] Date of Patent: Mar. 24, 1992

[54] RELAY CONTROL SYSTEM

[75] Inventor: Chia-Chi Chin, Hsinchu, Taiwan

[73] Assignee: Accton Technology Corp., Taiwan

[21] Appl. No.: 320,989

[22] Filed: Mar. 9, 1989

[51] Int. Cl.[5] ..... H01H 47/00

[52] U.S. Cl. ..... 361/166; 307/636

[58] Field of Search ..... 361/160, 166, 167, 168.1, 361/169.1; 307/125, 126, 130, 131, 636

[56] References Cited

U.S. PATENT DOCUMENTS 3,521,130 7/1970 Davis et al. ..... 361/168.1
4,395,743 7/1983 Sunaga et al. ..... 361/166
4,449,056 5/1984 Shibazaki ..... 307/115
4,528,456 7/1985 Harris ..... 307/115

*Primary Examiner*—J. R. Scott
*Assistant Examiner*—Jeffrey A. Gaffin
*Attorney, Agent, or Firm*—Bacon & Thomas

[57] ABSTRACT

A relay control circuit regulates the Set and Reset states of a pair of latch-type relays utilizing only a relatively weak carrier signal. Each relay is controlled by a circuit including a programmable unijunction transistor that is triggered by the discharge of a storage capacitor to enable its respective relay to enter the set state. The carrier signal itself regulates the charging and discharging of the circuit capacitors, thus regulating the Set and Reset states of the respective relays.

5 Claims, 2 Drawing Sheets

RELAY CONTROL SYSTEM

BACKGROUND OF THE INVENTION

1. Field of the Invention

The present invention relates generally to a power-saving relay control system having a minimum number of parts, and more particularly to a relay control system for controlling a bi-stable latch-type relay.

2. Description of the Related Art

Commonly, relays having low voltage and small current characteristics must, in addition to supplying sufficient operating current, reserve holding current after operation to maintain relay contact for a specified period of time. As shown in FIG. 3*a*, a DC or AC power source and an inverter circuit I have been utilized to activate relay M when a Set pulse is at its maximum electric potential. In the case of a non-latch-type relay, relay M fails to maintain operation unless inverter I has been furnished with a high electric potential. Therefore, relay M continues to consume power. If a latch-type relay is used, resetting the relay is impossible after a set operation.

Turning to FIG. 3B, the addition of an independent Set Rely M1 and a Reset relay M2 is known for a latch-type relay, where M1 and M2 are given set and reset pulses, respectively, from separate control circuits. In such a circuit, a separate power source and control circuit must be included, and power must be continuously applied during operation of the relays.

In addition to the prior art need for overly sophisticated and non-economic use of circuit elements combined with large electric and thermal power consumption, the prior art relay control circuits are difficult to implement in conventional data communication switching equipment or remote control equipment where no appropriate power supply can be readily accessed.

SUMMARY OF THE INVENTION

Accordingly, the present invention provides a latch-type relay control circuit that is free of the need for external power supplies, but simply uses a regulated carrier signal stored in a plurality of capacitors that are charged and discharged by way of programmable uni-junction transistors (PUTs) to set and reset relay contacts in an easily controllable manner.

DETAILED DESCRIPTION OF THE PREFERRED EMBODIMENTS

Figure 1:
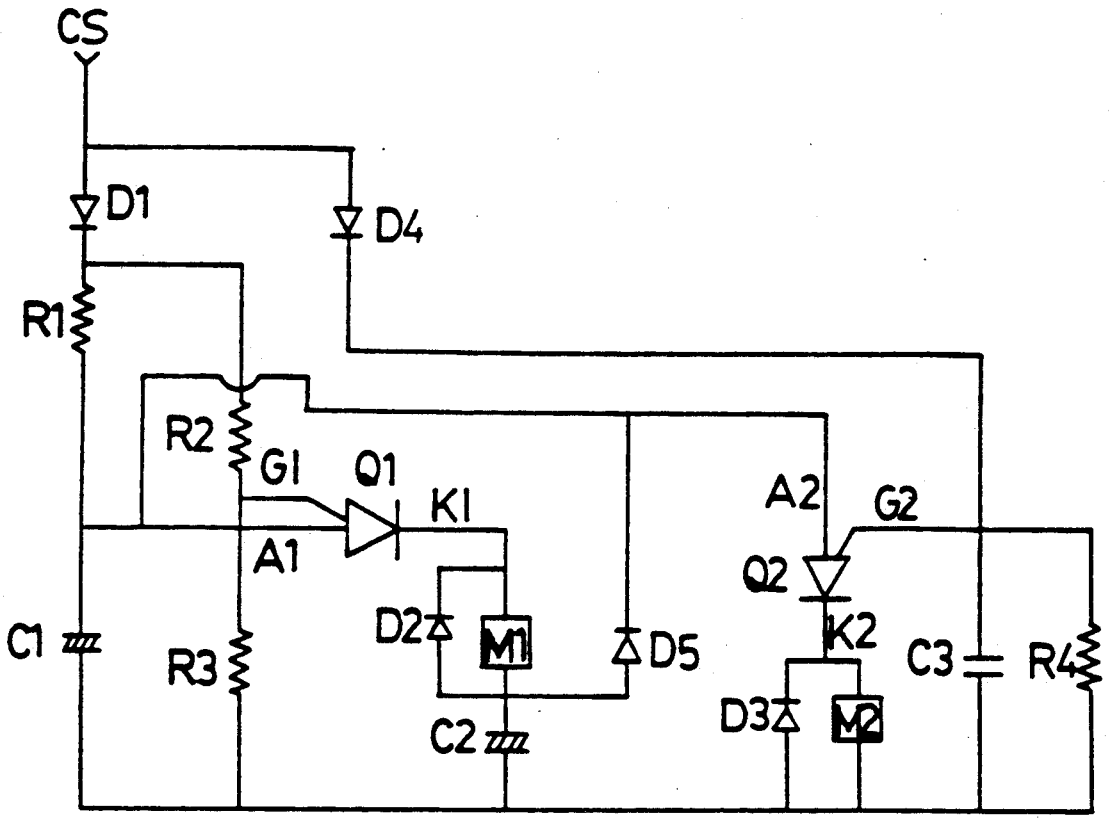
FIG. 1 illustrates a preferred form of the inventive relay control circuit.
Figure 1A:
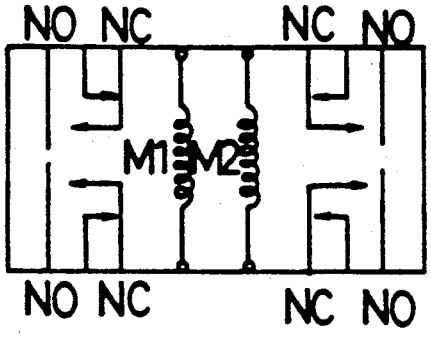
FIG. 1A is a schematic showing of the relay coils and contacts.
Figure 2:
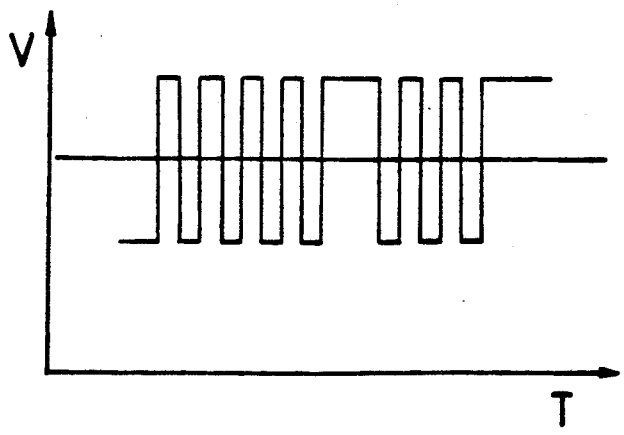
FIG. 2 illustrates a possible digital carrier signal that may be input to the inventive circuit.
Figure 3:
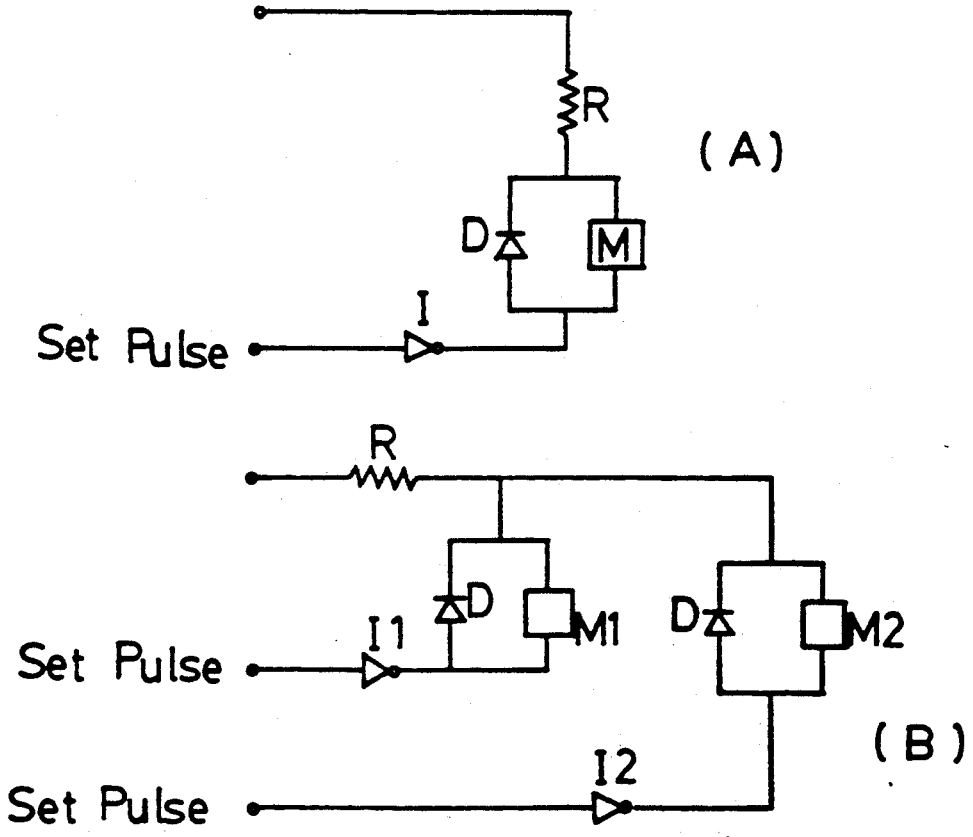
FIG. 3 PRIOR ART
FIGS. 3A and 3B show prior art relay control circuits.

With reference to FIGS. 1, 1A and 2, the input carrier signal CS is split along two paths at the input to the relay control circuit of the invention. The first path is through diode D1, resistor R1, to capacitor C1, while the second path is through diode D4 to the parallel combination of resistor R4 and capacitor C3. The following formulas, as known, describe the voltage drops along these two paths:

$$V_{CS} = I_1R_1 + V_{D1} + \frac{1}{C_1}\int I_1 dt$$

and $$V_{CS} = \frac{1}{C_3}\int I_3 dt + V_{D4}$$

Since C3 is smaller than C1, less time is required to fully charge C3 than to fully charge C1. Q1 and Q2 are PUTs associated with relays M1 and M2, respectively, Concerning the first path, a voltage divider comprising resistors R2 and R3 sets a voltage at the two inputs to PUT Q1, which inputs are represented by G1 and A1. The voltage set at the inputs is D3, R3/(R2+R3), which voltage is added to gate G1 so long as the pontential at anode A1 of Q1 is higher than that at G1. When the voltage is at 0.6 V or above, Q1 conducts due to the lowered resistance between A1 and K1 as is known to the art, thus charging C2 through Q1 with current discharged from C1.

Current flowing through Q1 thus sets the coil of relay M1, enabling C2 to charge and maintain the set state of M1. When C2 is fully charged, its voltage is approximately that of C1, since C1 and C2 are preferably designed to be approximately equal in capacitance.

Concerning the second path mentioned above, voltage at anode A2 of PUT Q2 is not larger than that at gate G2. Therefore, Q2 is in the off state. M1 is thus latched, with the entire inventive control circuit depending only upon the regulated, weak carrier signal, provided that no significant leakage through the capacitors occurs.

When the carrier signal shown in FIG. 2 undergoes transition, capacitor C3 discharges through resistor R4, thus lowering the potential at gate G2. When the potential at G2 reaches a point approximately 0.6 volts below that at A2, PUT Q2 turns on to cause current to flow from A2 to K2, with a relatively large instantaneous current passing from C1 and C2 to reset with a relay M2. Therefore, relay M2 is set and latched at the same time that relay M1 is reset, thus maintaining the state of the circuit.

The relay control system thus described controls the Set and Reset states of latch-type relays M1 and M2 without requiring a separate DC power source or any other complicated control circuitry. Instead, by using only the regulated and relatively weak carrier signal, the inventive circuit takes advantage of the negative resistance features of programmable uni-junction transistors to accurately effect relay operation using only the charging and discharging characteristics of a plurality of capacitors.

I claim:

1. A latch-type relay control circuit, comprising:

a first storage circuit including a first resistor and a first capacitor;

a second charge storage circuit including a second capacitor;

a first programmable unijunction transistor having a gate and anode electrically connected to said first capacitor;

a first relay having one contact electrically connected to the output of said first programmable unijunction transistor;

a third capacitor electrically connected to the second contact of said first relay;

a second programmable unijunction transistor having an anode electrically connected to the first capacitor and a gate electrically connected to the second capacitor; and a second relay electrically connected to the output of said second programmable unijunction transistor; wherein the first and second relays alternate between Set and Reset states so that one is set while the other is reset, and wherein a carrier signal undergoes a transition between a first state and a second state to thereby alternate the Set and Reset states of the two relays.

2. A relay control circuit as claimed in claim 1, wherein the second capacitor has smaller capacitance than the first capacitor.

3. A relay control circuit as claimed in claim 2, further comprising a voltage divider for setting a voltage at the gate of the first programmable unijunction transistor so that the first programmable unijunction transistor conducts when the first capacitor reaches saturation.

4. A relay control circuit as claimed in claim 1, wherein the charge on the third capacitor maintains the Set state of the first relay.

5. A relay control circuit as claimed in claim 1, further comprising a second resistor in parallel with the second capacitor, wherein the second programmable unijunction transistor conducts when the electric potential on its gate falls below a threshold voltage less than the potential on the anode of the second programmable unijunction transistor, said potential on the second programmable unijunction transistor gate being reduced by the discharge of the second capacitor through the second resistor.

* * * * *

UNITED STATES PATENT AND TRADEMARK OFFICE

CERTIFICATE OF CORRECTION

PATENT NO. : 5,099,384

DATED : March 24, 1992

INVENTOR(S) : Wang

It is certified that error appears in the above-identified patent and that said Letters Patent is hereby corrected as shown below:

Title page item [19], [75] the Inventor's name should be corrected to read:

—Chih-Yen Wang—

Signed and Sealed this

Third Day of August, 1993

Michael K. Kirk

*Attest:*

MICHAEL K. KIRK

*Attesting Officer*

*Acting Commissioner of Patents and Trademarks*